US005568163A

United States Patent [19]

Okumura

[11] Patent Number: 5,568,163

[45] Date of Patent: Oct. 22, 1996

[54] APPARATUS FOR DRIVING GATE STORAGE TYPE LIQUID CRYSTAL, DISPLAY PANEL CAPABLE OF SIMULTANEOUSLY DRIVING TWO SCAN LINES

[75] Inventor: Fujio Okumura, Tokyo, Japan

[73] Assignee: NEC Corporation, Japan

[21] Appl. No.: 300,800

[22] Filed: Sep. 2, 1994

[30] Foreign Application Priority Data

Sep. 6, 1993 [JP] Japan ..... 5-220749

[51] Int. Cl.[6] ..... G09G 3/36

[52] U.S. Cl. ..... 345/100; 345/92

[58] Field of Search ..... 345/90, 94, 96, 345/99, 100, 92; 359/57–60

[56] References Cited

U.S. PATENT DOCUMENTS

| | | | |
|---|---|---|---|
| 5,032,832 | 7/1991 | Clerc et al. | 345/94 |
| 5,206,634 | 4/1993 | Matsumoto et al. | 345/99 |

FOREIGN PATENT DOCUMENTS

| | | | |
|---|---|---|---|
| 0449508 | 10/1991 | European Pat. Off. | 345/96 |
| 2-50132 | 2/1990 | Japan | 345/92 |

OTHER PUBLICATIONS

T. P. Brody et al. "A 6×6 Inch 20 Lines-per-Inch Liquid--Crystal Display Panel", IEEE Transactions on Electron Devices, vol. ED-20, No. 11, Nov. 1973, pp. 995–1001.

Shinji Morozumi et al, "4.25-in. and 1.51-in. B/W and Full-Color LC Video Displays Addressed by Poly-Si TFTs", SID 84 Digest, 1984, pp. 316–319.

Masahiro Adachi et al, "A High-Resolution TFT-LCD for a High-Definition Projection TV", SID 90 Digest, 1990, pp. 338–341.

Y. Takafuji et al, "A 1.9-in. 1.5-MPixel Driver Fully-Integrated Poly-Si TFT-LCD for HDTV Projection", SID 93 Digest, 1993, pp. 383–386.

*Primary Examiner*—Jeffery Brier

*Attorney, Agent, or Firm*—Ostrolenk, Faber, Gerb & Soffen, LLP

[57] ABSTRACT

In an apparatus for driving a gate storage type liquid crystal display panel having gate lines, two gate pulse signals are simultaneously supplied to two adjacent ones of the gate lines, to thereby drive them. The two gate pulses differ in that at least one of a rising edge and a falling edge of one of the two gate pulses differs from that of the other.

10 Claims, 20 Drawing Sheets

PRIOR ART

PRIOR AR

SIGNAL LINE DRIVING CIRCUIT
3
1280
2-R
2-L
512
512
1
GATE LINE SCANNING CIRCUIT
SL_i
GL_{i-1}
GL_i
φR
φR̄
STR
INHR
φL
φL̄
φR
φR̄
STL
INHL
STR
INHR
STH
φH
SIGNAL PROCESSING CIRCUIT
6
HORIZONTAL TIMING GEN.
5
VERTICAL TIMING GEN.
4
R
G
B
HSYNC
VSYNC

Fig. 8A INH

Fig. 8B O/E ODD FIELD EVEN FIELD

Fig. 8C INHL

Fig. 8D INHR

SIGNAL LINE DRIVING CIRCUIT
3
1280
GLi-1
GLi
SLj
1
1024
2'
GATE LINE SCANNING CIRCUIT
STH
φH
φ
φ̄
ST
INHL
INHR
O/E
O/E
SIGNAL PROCESSING CIRCUIT
6
HORIZONTAL TIMING GEN.
5
VERTICAL TIMING GEN.
4'
R
G
B
HSYNC
VSYNC

Fig. 17A INH

Fig. 17B O/E ODD FIELD EVEN FIELD

Fig. 17C INHL

Fig. 17D INHR

ODD FIELD
EVEN FIELD
O/E
$\overline{O/E}$
INHL
INHR
ST
$\phi$
$\overline{\phi}$
$GL_1$
$GL_2$
$GL_3$
$GL_4$
$GL_5$
$GL_6$

APPARATUS FOR DRIVING GATE STORAGE TYPE LIQUID CRYSTAL, DISPLAY PANEL CAPABLE OF SIMULTANEOUSLY DRIVING TWO SCAN LINES

BACKGROUND OF THE INVENTION

1. Field of the Invention

The present invention relates to an apparatus for driving a gate storage type liquid crystal display (LCD) panel.

2. Description of the Related Art

Active matrix LCD panels using thin film transistors (TFT's) have been developed in terms of resolution and performance.

In a prior gate storage type active matrix LCD panel (see: T. P. Brody: "A 6×6 inch 20 lines-per-Inch Liquid-Crystal Display Panel", IEEE Trans. of Electron Devices, Vol. ED-20, No. 11, pp. 995–1001, Nov. 1973), each pixel has a storage capacitor formed on an adjacent gate line, to thereby increase the capacity of the pixels. As a result, the feed-through of gate pulse signals is reduced, and a pixel voltage deviation caused by the leakage current of liquid crystal cells and TFT's is reduced. This will be explained later in detail.

On the other hand, a two gate line driving method is applied to a storage capacitor line type active matrix LCD panel (see: Shinji Morozumi et al., "4.25-in and 1.51-in B/W and Full-Color LC Video Displays Addressed by Poly-Si TFT's", SID 84 Digest, pp. 316–319, 1984; Masahiro Adachi et al., "A High-Resolution TFT-LCD for a High-Definition Projection TV", SID 90 Digest, pp. 338–341, 1990). According to the two gate line driving method, in non-interlace scanning, the pulse width of a gate pulse signal applied to gate lines can be twice that of the conventional one gate driving method, to enlarge the margin of a write operation and reduce the frequency of operation. Also, when the ability of the TFT's is small or when the number of gate lines is large, effective use is made of the two gate line driving method. Further, since non-interlace scanning is used, the resolution is high and the flicker is small. This will be explained later in detail.

In the prior art, however, it is impossible to apply the two gate line driving method to a gate storage type active matrix LCD panel. This will also be explained later in detail.

SUMMARY OF THE INVENTION

It is, therefore, an object of the present invention to provide an apparatus for driving a gate storage type LCD panel capable of carrying out the two gate line driving method.

According to the present invention, in an apparatus for driving a gate storage type LCD panel having gate lines, two gate pulse signals are simultaneously supplied to two adjacent gate lines, to thereby drive them. The pulse widths of the two gate pulse signals are independently controlled.

BRIEF DESCRIPTION OF THE DRAWINGS

The present invention will be more clearly understood from the description as set forth, in comparison with the prior art, with reference to the accompanying drawings, wherein:

FIGS. 8A through 8D are timing diagrams showing the operation of the circuit of FIG. 7;

FIGS. 17A through 17D are timing diagrams showing the operation of the circuit of FIG. 16;

DESCRIPTION OF THE PREFERRED EMBODIMENTS

Before the description of the preferred embodiments, prior art active matrix LCD panels will be explained with reference to FIGS. 1, 2A through 2F, 3 and 4A through 4F.

Figure 1:
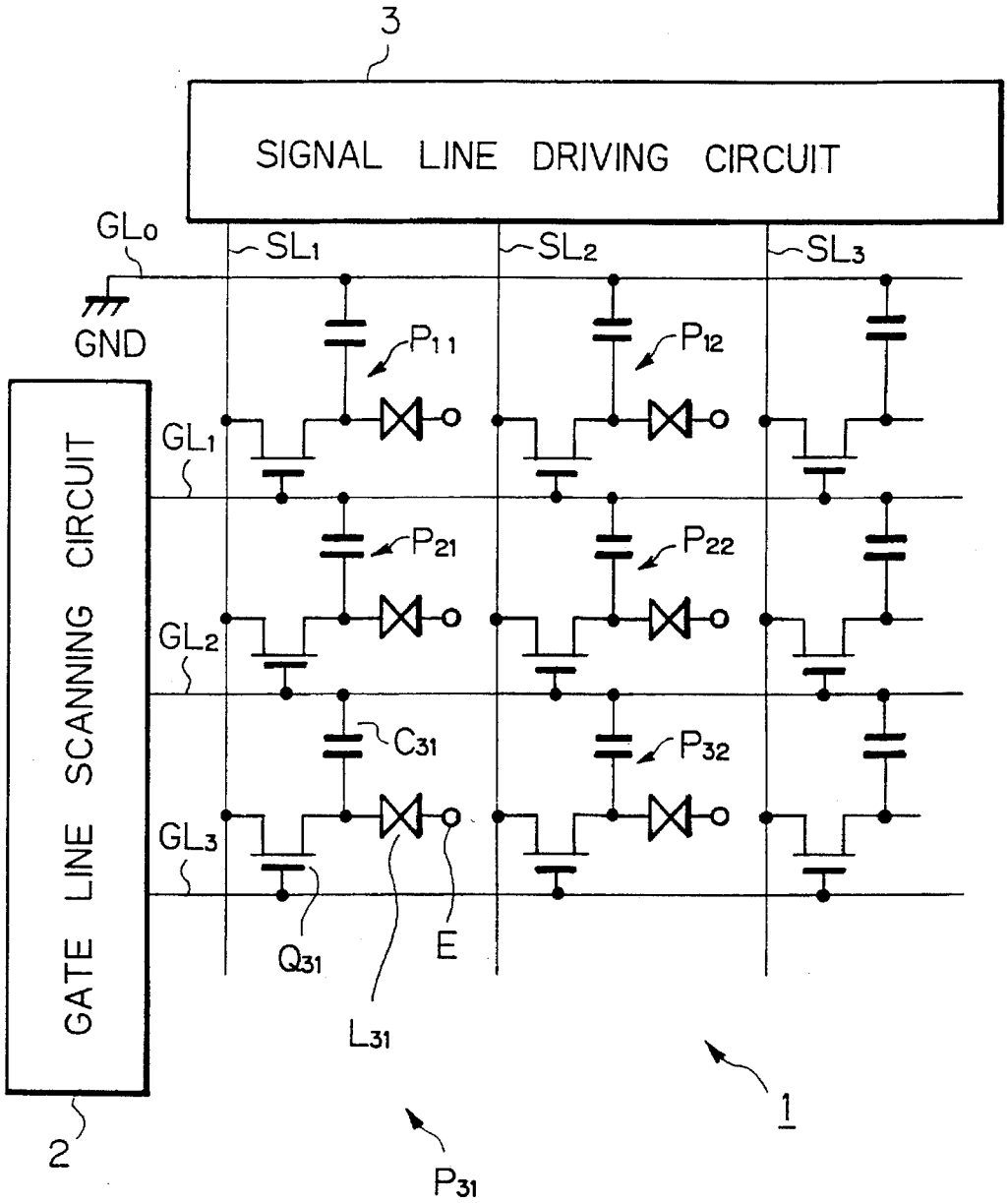
Fig. 1 PRIOR ART
FIG. 1 is a circuit diagram illustrating a prior art gate storage type active matrix LCD panel.
Figure 2:
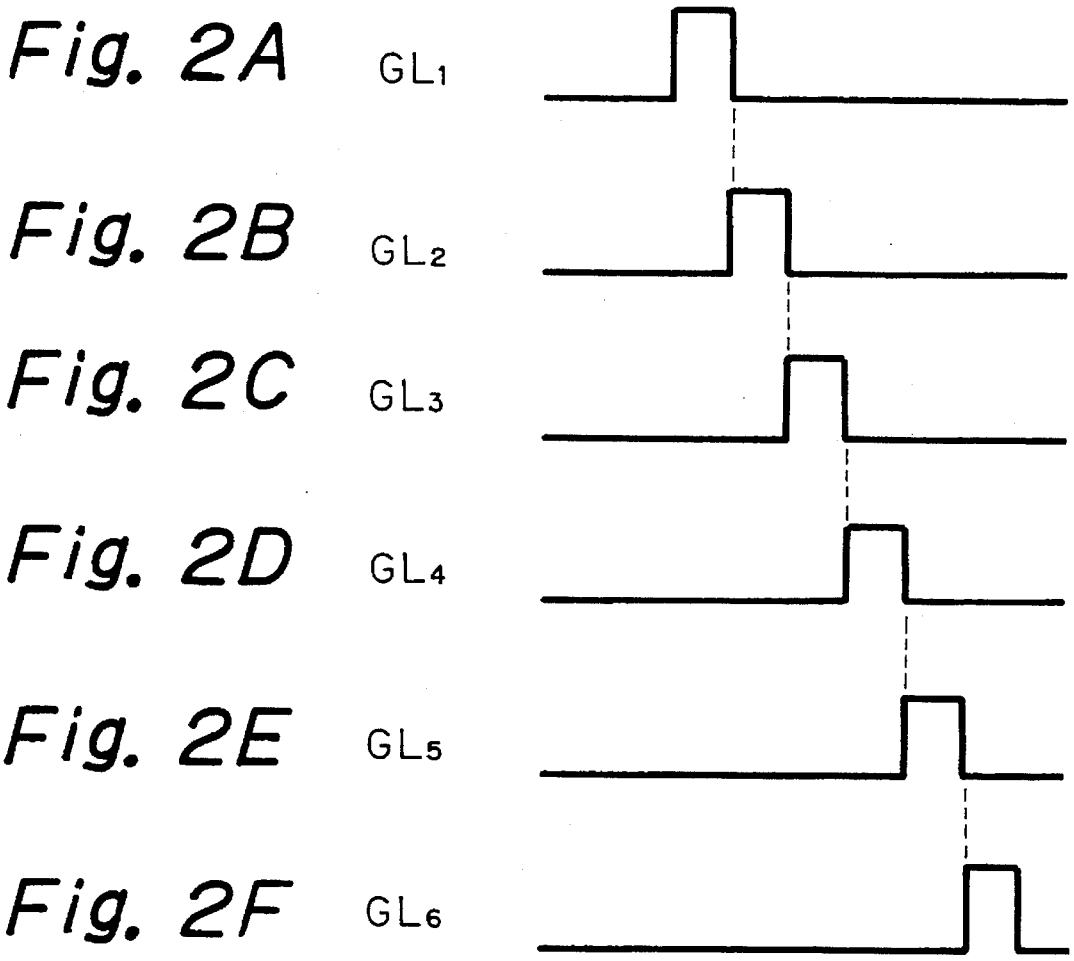
FIGS. 2A through 2F are timing diagrams showing the operation of the apparatus of FIG. 1.

In FIG. 1, which illustrates a prior art gate storage type active matrix LCD panel, reference numeral 1 designates a pixel array including a plurality of pixels $P_{11}$, $P_{12}$, . . . connected to gate lines $GL_1$, $GL_2$, . . . driven by a gate line scanning circuit 2 and to signal lines $SL_1$, $SL_2$, . . . driven by a signal line driving circuit 3. In more detail, each of the pixels, such as $P_{31}$, includes a liquid crystal cell $L_{31}$ connected to a common counter electrode E, a TFT $Q_{31}$ connected between the signal line $SL_1$ and the liquid crystal cell $L_{31}$ and controlled by the potential at the gate line $GL_3$, and a storage capacitor $C_{31}$ connected between the liquid crystal cell $L_{31}$ and the gate line $GL_2$ adjacent to the gate line $GL_3$. Thus, due to the presence of the storage capacitors, such as $C_{31}$, the capacity of the pixels is increased. That is, only when each of the gate lines $GL_1$, $GL_2$, . . . are selected for a small time period, is the potential thereof made high as shown in FIGS. 2A through 2F. Otherwise, the gate lines $GL_1$, $GL_2$, . . . remain at a definite potential such as the ground potential GND. Therefore, the gate lines $GL_1$, $GL_2$, . . . can serve as counter electrodes of capacitors. Note that an additional gate line $GL_0$ is provided only for the storage capacitors of the pixels $P_{11}$, $P_{12}$, . . . and the potential at the gate line $GL_0$ always remains at the ground potential GND.

Figure 3:
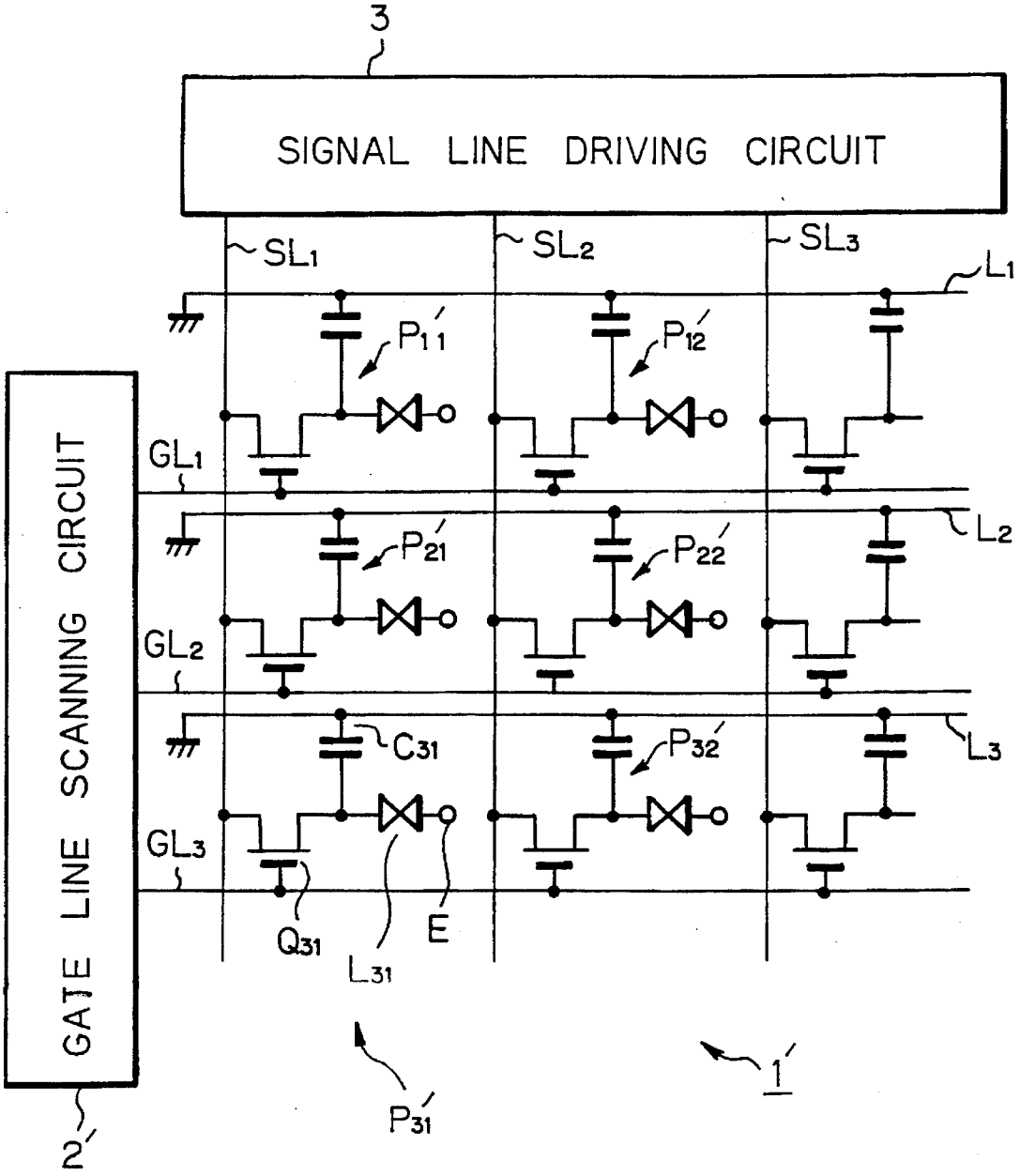
Fig. 3 PRIOR ART
FIG. 3 is a circuit diagram illustrating a prior art storage capacitor line type active matrix LCD panel.
Figures 4A, 4B, 4C, 4D, 4E, 4F:
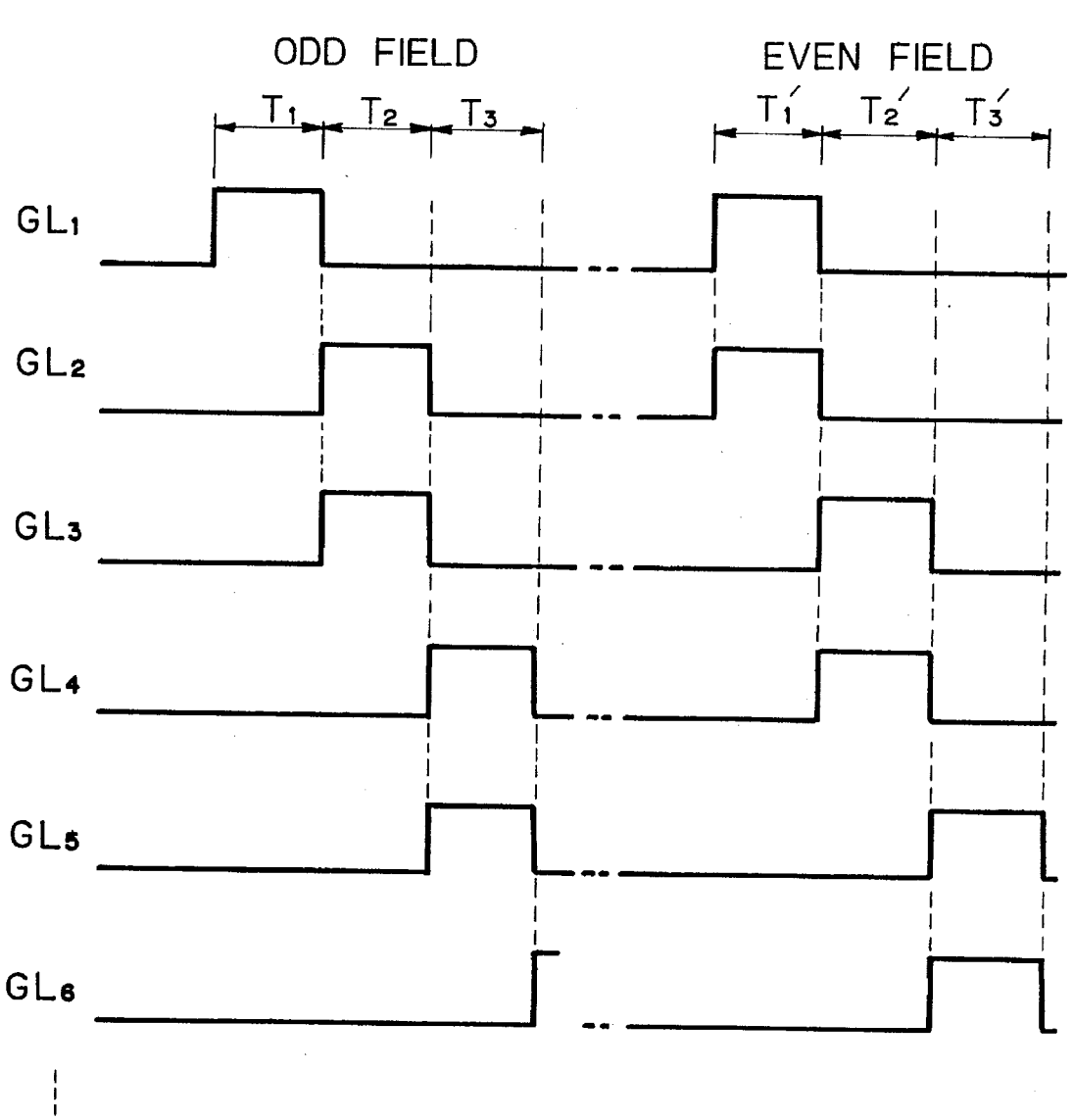
FIGS. 4A through 4F are timing diagrams showing the operation of the apparatus of FIG. 3.
Figures 5A, 5B, 5C, 5D, 5E, 5F:
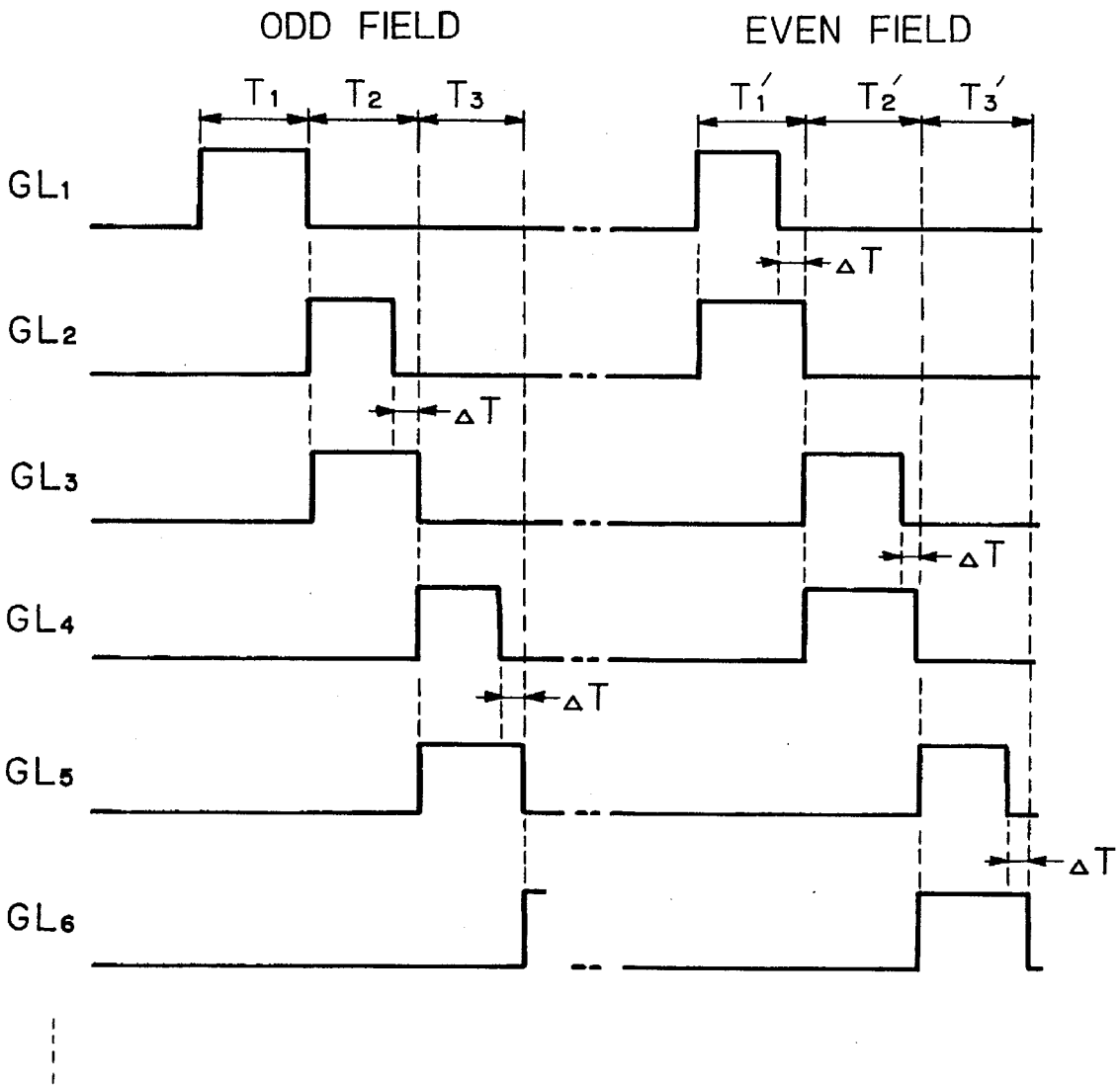
FIGS. 5A through 5F are timing diagrams explaining a first principle of the present invention.

Thus, in FIG. 1, since the capacity of the pixels is increased, the availability of an area is increased as compared with a storage capacitor line type LCD panel (see: FIG. 3), so that the aperture ratio for light is enlarged. In other words, if the aperture ratio for light is the same, the feed-through of gate pulse signals is reduced, and also, a pixel voltage deviation caused by the leakage current of the liquid crystal cells and the TFT's is reduced.

In FIG. 3, which illustrates a prior art storage capacitor line type active matrix LCD panel, a pixel array 1' includes a plurality of pixels $P_{11}'$, $P_{12}'$, . . . connected to the gate lines $GL_1$, $GL_2$, . . . driven by a gate line scanning circuit 2' and to the signal lines $SL_1$, $SL_2$, . . . driven by the signal line driving circuit 3. In this case, each of the pixels $P_{11}'$, $P_{12}'$, . . . is the same as the pixels $P_{11}$, $P_{12}$, . . . of FIG. 1, except that the storage capacitors, such as $C_{31}$, are connected to additional storage capacitor lines $L_1$, $L_2$, . . . . Also, the additional gate line $GL_0$ of FIG. 1 is not provided.

The scanning operation of the gate lines $GL_1$, $GL_2$, . . . of FIG. 3 is next explained with reference to FIGS. 4A through 4F. In an odd field mode, the gate line $GL_1$ is driven for a time period $T_1$; the gate lines $GL_2$ and $GL_3$ are simultaneously driven for a time period $T_2$; the gate lines $GL_4$ and $GL_5$ are simultaneously driven for a time period $T_3$; and the like. That is, a pair of the gate lines $GL_i$ and $GL_{i+1}$ (i=2, 3, . . . ) are simultaneously driven. On the other hand, in an even field mode, the gate lines $GL_1$ and $GL_2$ are simultaneously driven for a time period $T_1'$; the gate lines $GL_3$ and $GL_4$ are simultaneously driven for a time period $T_2'$; the gate lines $GL_5$ and $GL_6$ are simultaneously driven for a time period $T_3'$; and the like. That is, a pair of the gate lines $GL_i$ and $GL_{i+1}$ (i=1, 2, . . . ) are simultaneously driven. In FIGS. 4A through 4F, in non-interlace scanning, the pulse width of a gate pulse signal applied to the gate lines $GL_1$, $GL_2$, . . . can be twice that as shown in FIGS. 2A through 2F, to enlarge the margin of a write operation and reduce the frequency of operation. Also, when the ability of the TFT's is small or when the number of gate lines is large, effective use is made of the two gate line driving method. Further, since non-interlace scanning is used, the resolution is high and the flicker is small.

If the two gate line driving method as shown in FIGS. 4A through 4F is applied to the gate storage type active matrix LCD panel of FIG. 1, the following problem may occur. That is, for example, consider that the gate lines $GL_4$ and $GL_5$ are simultaneously driven for the time period $T_3$ as shown in FIGS. 4A through 4F. In this case, since a write operation upon the gate line $GL_3$ is completed so that the potential at the gate line $GL_3$ is definite, the potential at the gate line $GL_3$ hardly affects the potential at the liquid crystal cells belonging to the gate line $GL_4$. However, since the potentials at the gate lines $GL_4$ and $GL_5$ are changed simultaneously from high to low, the potential at the gate line $GL_4$ may affect the potentials at the liquid crystal cells belonging to the gate line $GL_5$ due to the capacitive coupling therebetween by the storage capacitors connected to the gate line $GL_4$. Note that, generally, the capacity of each storage capacitor is larger than or equal to that of each liquid crystal cell. Therefore, the potentials at the liquid crystal cells belonging to the gate line $GL_5$ may be fluctuated, that is, the pixel potentials may be fluctuated.

FIGS. 5A through 5F are timing diagrams for explaining a first principle of the present invention. For example, in the pair of the gate lines $GL_4$ and $GL_5$ simultaneously driven for the time period $T_3$, the gate line $GL_4$ is changed from high to low by a time period $\Delta T$ prior to the change of the potential at the gate line $GL_5$. For example, if each of the time periods $T_1$, $T_2$, . . . , $T_1'$, $T_2'$, . . . is about 30 μm, the time period $\Delta T$ is about 5 μm. As a result, since a write operation upon the gate line $GL_4$ is also completed so that the potential at the gate line $GL_4$ is definite, the potential at the gate line $GL_4$ also hardly affects the potential at the liquid crystal cells belonging to the gate line $GL_5$.

Figure 6:
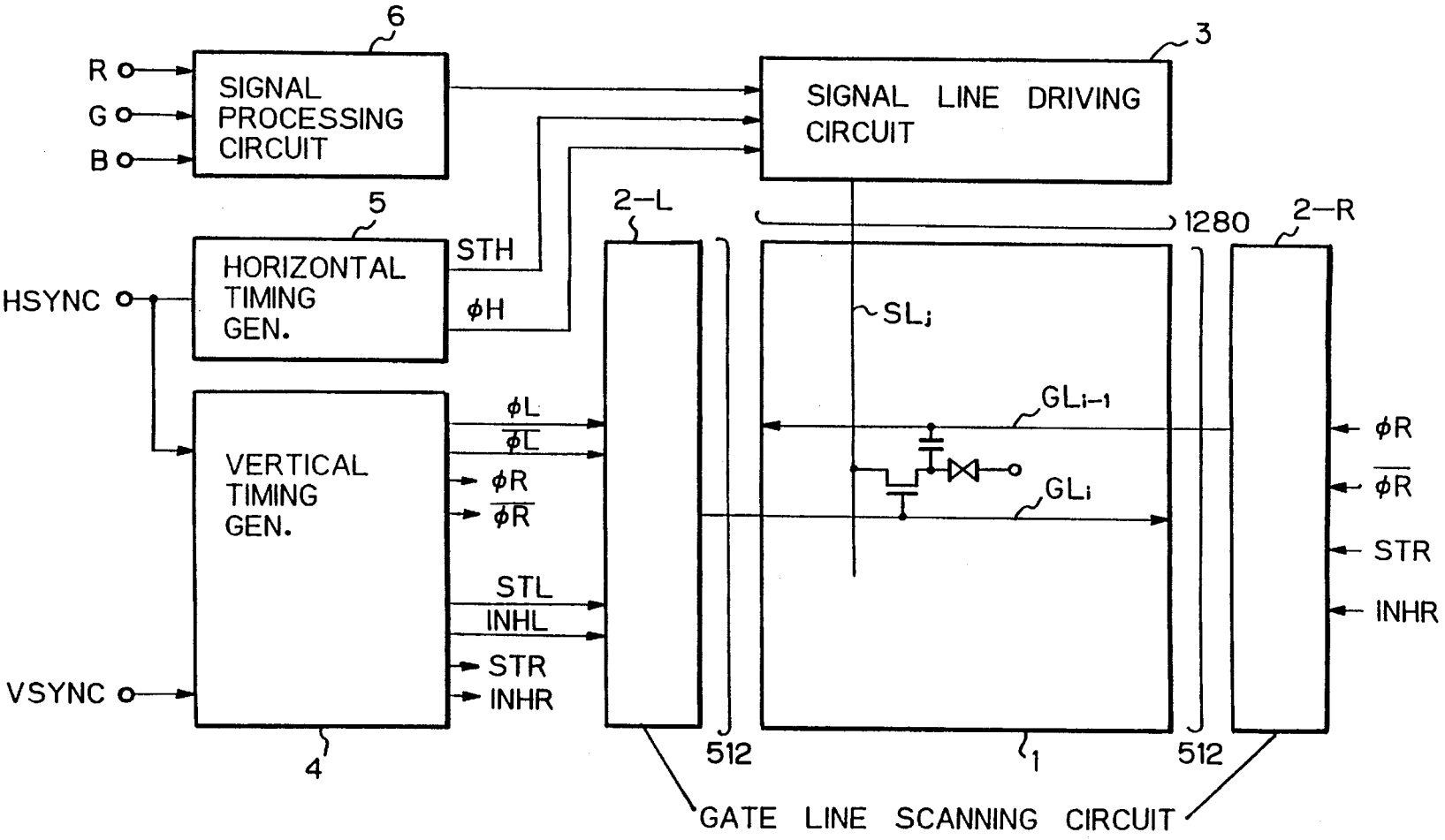
FIG. 6 is a circuit diagram illustrating a first embodiment of the gate storage type active matrix LCD panel according to the present invention.

In FIG. 6, which is a first embodiment of the present invention for realizing the first principle of FIGS. 5A through 5F, the pixel array 1 includes 1280×1024 pixels. A gate line scanning circuit 2-L is used for driving the gate lines $GL_1$, $GL_3$, . . . , and $GL_{1023}$, and a gate line scanning circuit 2-R is used for driving the gate lines $GL_2$, $GL_4$, . . . , and $GL_{1024}$.

A vertical timing generating circuit 4 receives a vertical synchronization signal VSYNC and a horizontal synchronization signal HSYNC, to generate a start pulse signal STL, an inhibit signal INHL, and clock signals $\phi$ L and $\overline{\phi L}$ for the gate line scanning circuit 2-L, and to generate a start pulse signal STR, an inhibit signal INHR, and clock signals $\phi$R and $\overline{\phi R}$ for the gate line scanning circuit 2-R.

Similarly, a horizontal timing generating circuit 5 receives the horizontal synchronization signal HSYNC to generate a start pulse signal STH and a clock signal $\phi$H for the signal line driving circuit 3. Also, a signal processing circuit 6 receives color signals R, G and B, to thereby generate digital output signals and transmit then to the signal line driving circuit 3.

Figure 7:
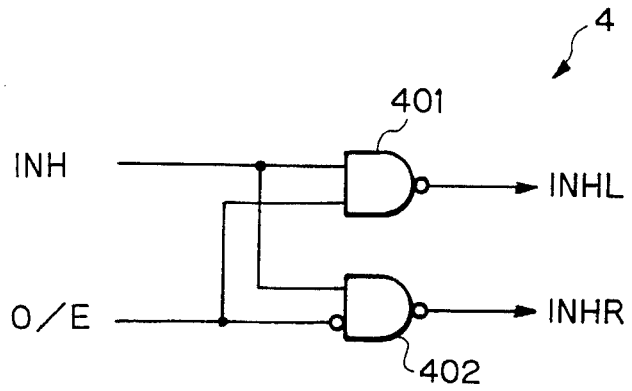
FIG. 7 is a partial circuit diagram of the vertical timing generating circuit of FIG. 6.

In FIG. 7, which is a partial circuit diagram of the vertical timing generating circuit 4 of FIG. 6, an inhibit signal INH as shown in FIG. 8A is supplied to NAND circuits 401 and 402 which are controlled by an odd/even field signal O/E as shown in FIG. 8B. That is, when the odd/even field signal O/E is "0" (odd field mode), the inhibit signal INHL for the gate line scanning circuit 2-L is inactive as shown in FIG. 8C and the inhibit signal INHR for the gate line scanning circuit 2-R is active as shown in FIG. 8D. Conversely, when the odd/even field signal O/E is "1" (even field mode), the inhibit signal INHL for the gate line scanning circuit 2-L is active as shown in FIG. 8C and the inhibit signal INHR for the gate line scanning circuit 2-R is inactive as shown in FIG. 8D.

Figure 9:
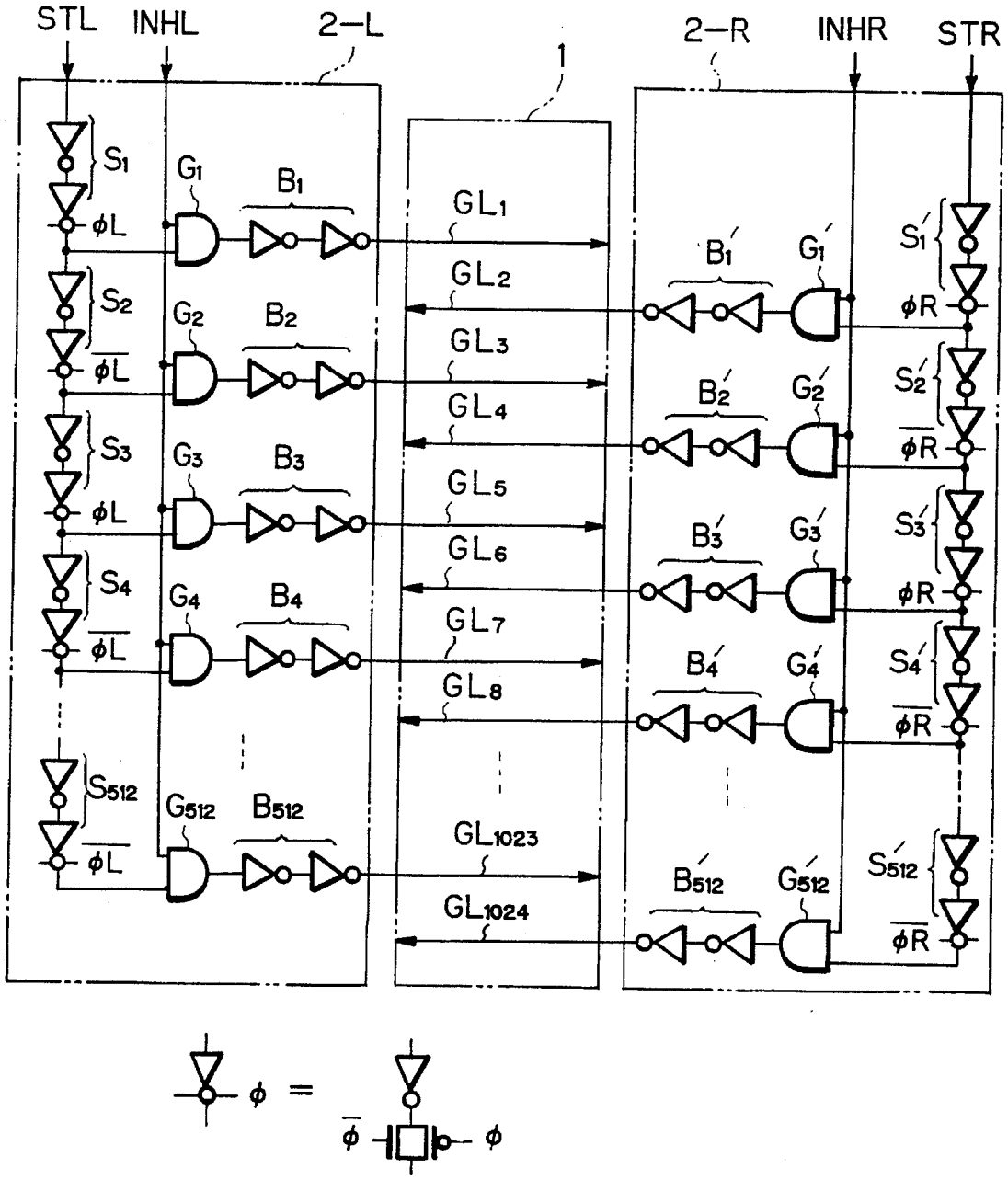
FIG. 9 is a detailed circuit diagram of the gate line scanning circuits of FIG. 6.
Figures 10A, 10B, 10C, 10D, 10E, 10F, 10G, 10H, 10I, 10J, 10K, 10L, 10M, 10N:
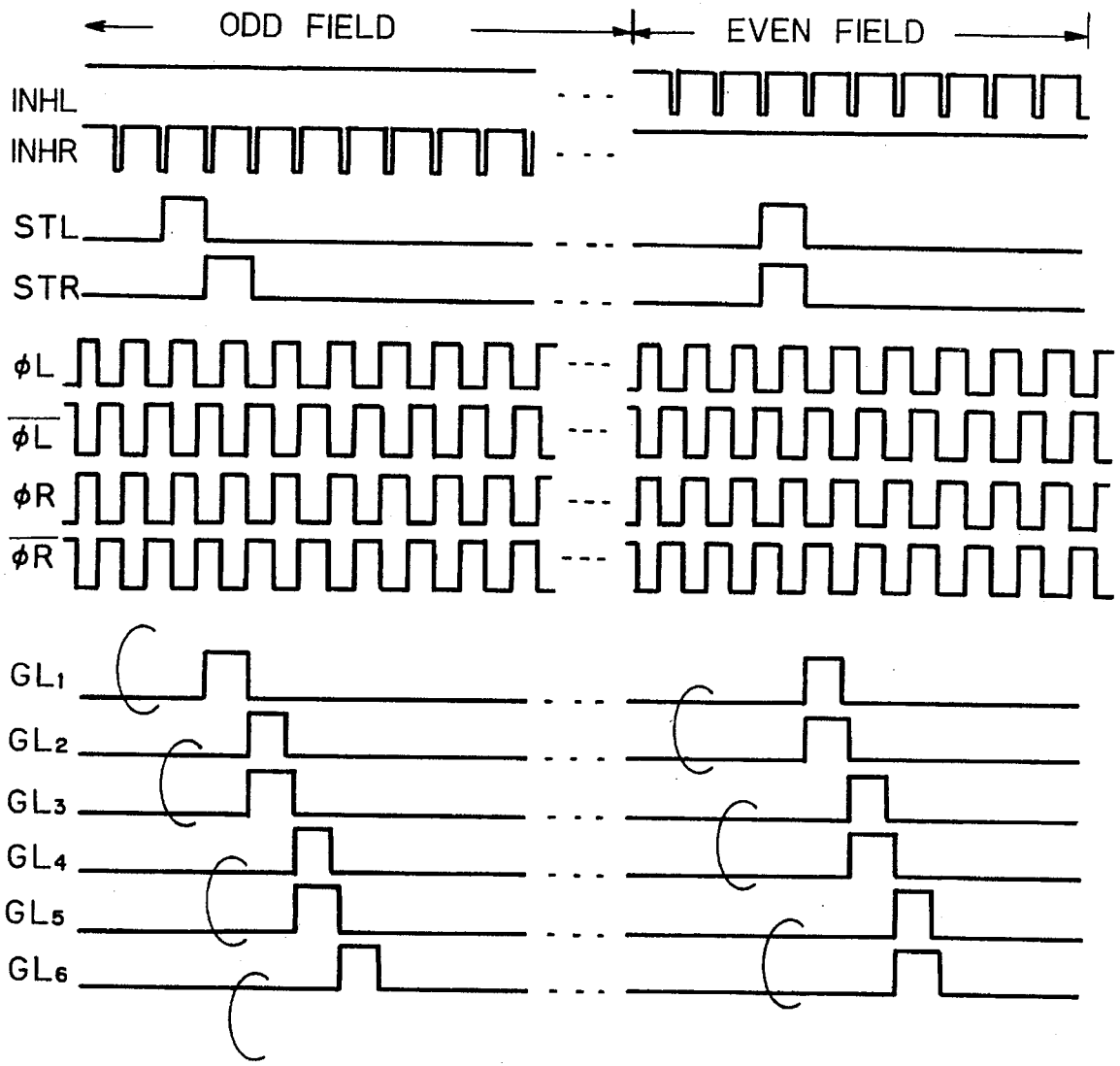
FIGS. 10A through 10N are timing diagrams showing the operation of the circuit of FIG. 9.

In FIG. 9, which is a detailed circuit diagram of the gate line scanning circuit 2-L and 2-R of FIG. 6, the gate line scanning circuit 2-L includes a shift register having 512 stages $S_1$, $S_2$, . . . , and $S_{512}$ for shifting the start pulse signal STL as shown in FIG. 10C in synchronization with the clock signal $\phi$L and $\overline{\phi L}$ as shown in FIGS. 10E and 10F to generate gate pulse signals for the gate lines $GL_1$, $GL_3$, . . . , and $GL_{1023}$. In this case, the gate pulse signals are supplied via AND circuits $G_1, G_2, \ldots$, and $G_{512}$ controlled by the inhibit signal INHL as shown in FIG. 10A and buffers $B_1, B_2, \ldots$, and $B_{512}$ to the gate lines $GL_1, GL_3, \ldots$, and $GL_{1023}$. Therefore, the gate pulse signals applied to the gate lines $GL_1$, $GL_3$, and $GL_5$ are shown in FIGS. 10I, 10K and 10M, respectively. Similarly, the gate line scanning circuit 2-R includes a shift register having 512 stages $S_1', S_2', \ldots$ and $S_{512}'$ for shifting the start pulse signal STR as shown in FIG. 10D in synchronization with the clock signal $\phi R$ and $\overline{\phi R}$ as shown in FIGS. 10G and 10H to generate gate pulse signals for the gate lines $GL_2, GL_4, \ldots$, and $GL_{1024}$. In this case, the gate pulse signals are supplied via AND circuits $G_1', G_2', \ldots$, and $G_{512}'$ controlled by the inhibit signal INHR as shown in FIG. 10B and buffers $B_1', B_2', \ldots$, and $B_{512}'$ to the gate lines $GL_2, GL_4, \ldots$, and $GL_{1024}$. Therefore, the gate pulse signals applied to the gate lines $GL_2$, $GL_4$, and $GL_6$ are shown in FIGS. 10J, 10L and 10N, respectively.

In an odd field mode, the inhibit signal INHL is inactive and the inhibit signal INHR is active as shown in FIGS. 10A and 10B. Also, the phase of the start pulse signal STL associated with the clock signals $\phi L$ and $\overline{\phi L}$ is advanced as compared with that of the start pulse signal STR associated with the clock signals $\phi R$ and $\overline{\phi R}$, as shown in FIGS. 10C, 10E and 10F and FIGS. 10D, 10G and 10H. Therefore, as shown in FIGS. 10I through 10N, the gate lines $GL_2$ and $GL_3$ are simultaneously driven, and the gate line $GL_2$ falls earlier than the gate line $GL_3$, and also, the gate lines $GL_4$ and $GL_5$ are simultaneously driven, and the gate line $GL_4$ falls earlier than the gate line $GL_5$.

In an even field mode, the inhibit signal INHL is active and the inhibit signal INHR is inactive as shown in FIGS. 10A and 10B. Also, the phase of the start pulse signal STL associated with the clock signals $\phi L$ and $\overline{\phi L}$ is the same as that of the start pulse signal STR associated with the clock signals $\phi R$ and $\overline{\phi R}$, as shown in FIGS. 10C, 10E and 10F and FIGS. 10D, 10G and 10H. Therefore, as shown in FIGS. 10I through 10N, the gate lines $GL_1$ and $GL_2$ are simultaneously driven, and the gate line $GL_1$ falls earlier than the gate line $GL_2$. Also, the gate lines $GL_3$ and $GL_4$ are simultaneously driven, and the gate line $GL_3$ falls earlier than the gate line $GL_4$. Further, the gate lines $GL_5$ and $GL_6$ are simultaneously driven, and the gate line $GL_5$ falls earlier than the gate line $GL_6$.

Figure 11:
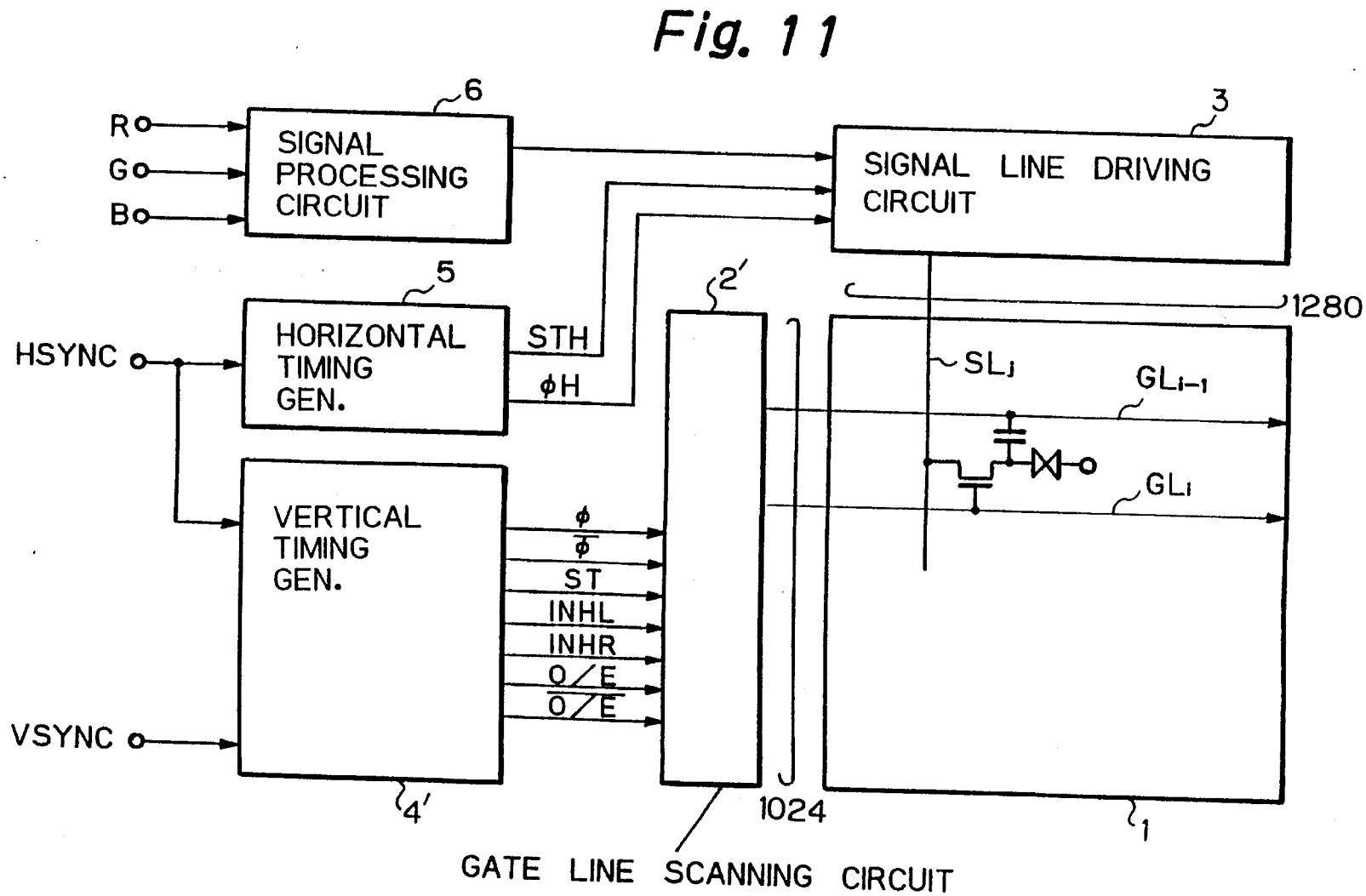
FIG. 11 is a circuit diagram illustrating a second embodiment of the gate storage type active matrix LCD panel according to the present invention.

In FIG. 11, which is a second embodiment of the present invention for realizing the first principle of FIGS. 5A through 5F, a gate line scanning circuit 2' is provided instead of the gate line scanning circuits 2-L and 2-R of FIG. 6, and a vertical timing generating circuit 4' is provided instead of the vertical timing generating circuit 4 of FIG. 6.

The vertical timing generating circuit 4' receives the vertical synchronization signal VSYNC and the horizontal synchronization signal HSYNC, to generate an odd/even field signal O/E, its inverted signal $\overline{O/E}$, a start pulse signal ST, an inhibit signal INHL, and clock signals $\phi$ and $\overline{\phi}$ for the gate line scanning circuit 2'.

Figure 12:
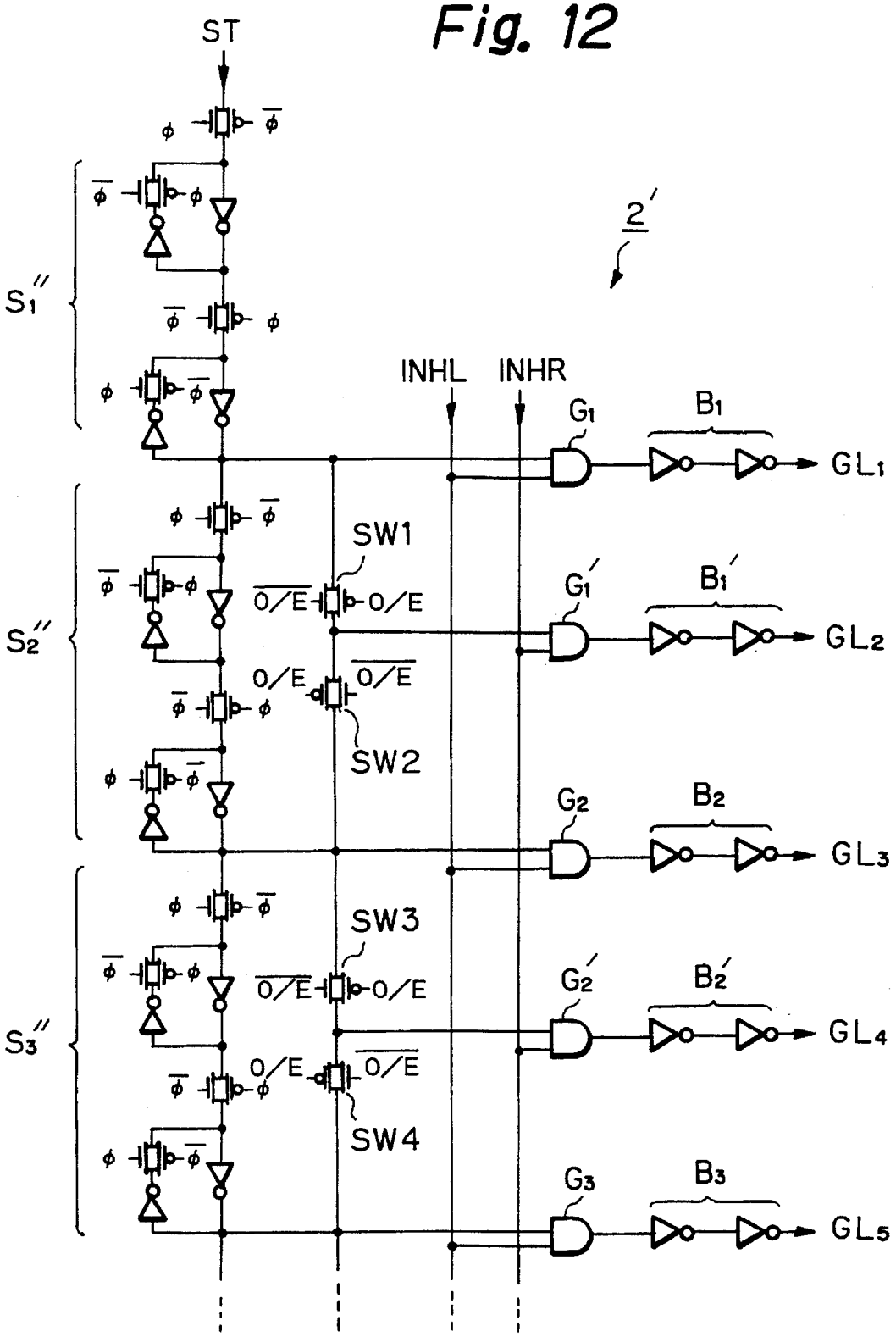
FIG. 12 is a detailed circuit diagram of the gate line scanning circuit of FIG. 11.
Figures 13A, 13B, 13C, 13D, 13E, 13F, 13G, 13H, 13I, 13J, 13K, 13L, 13M:
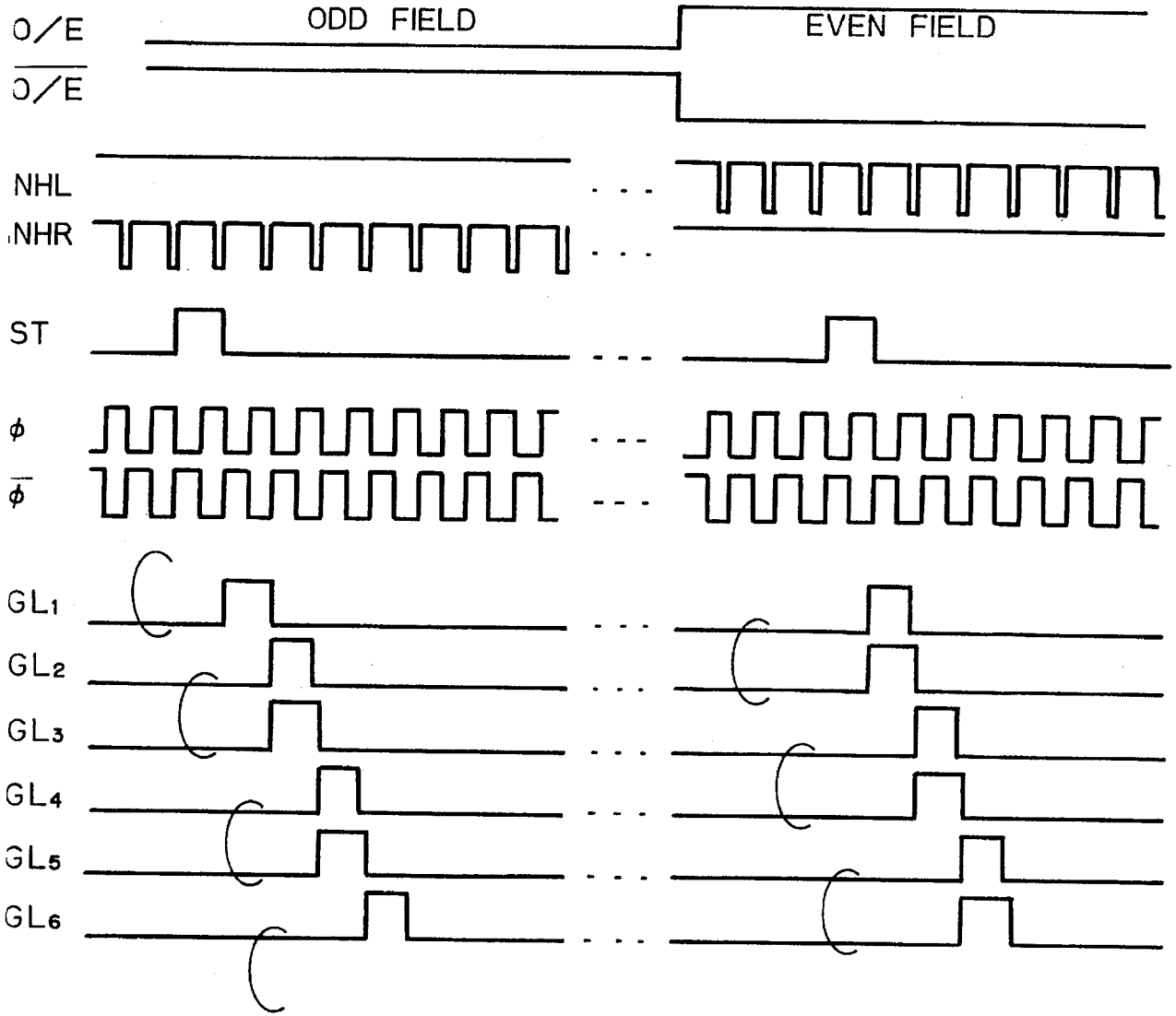
FIGS. 13A through 13M are timing diagrams showing the operation of the circuit of FIG. 12.
Figures 14A, 14B, 14C, 14D, 14E, 14F:
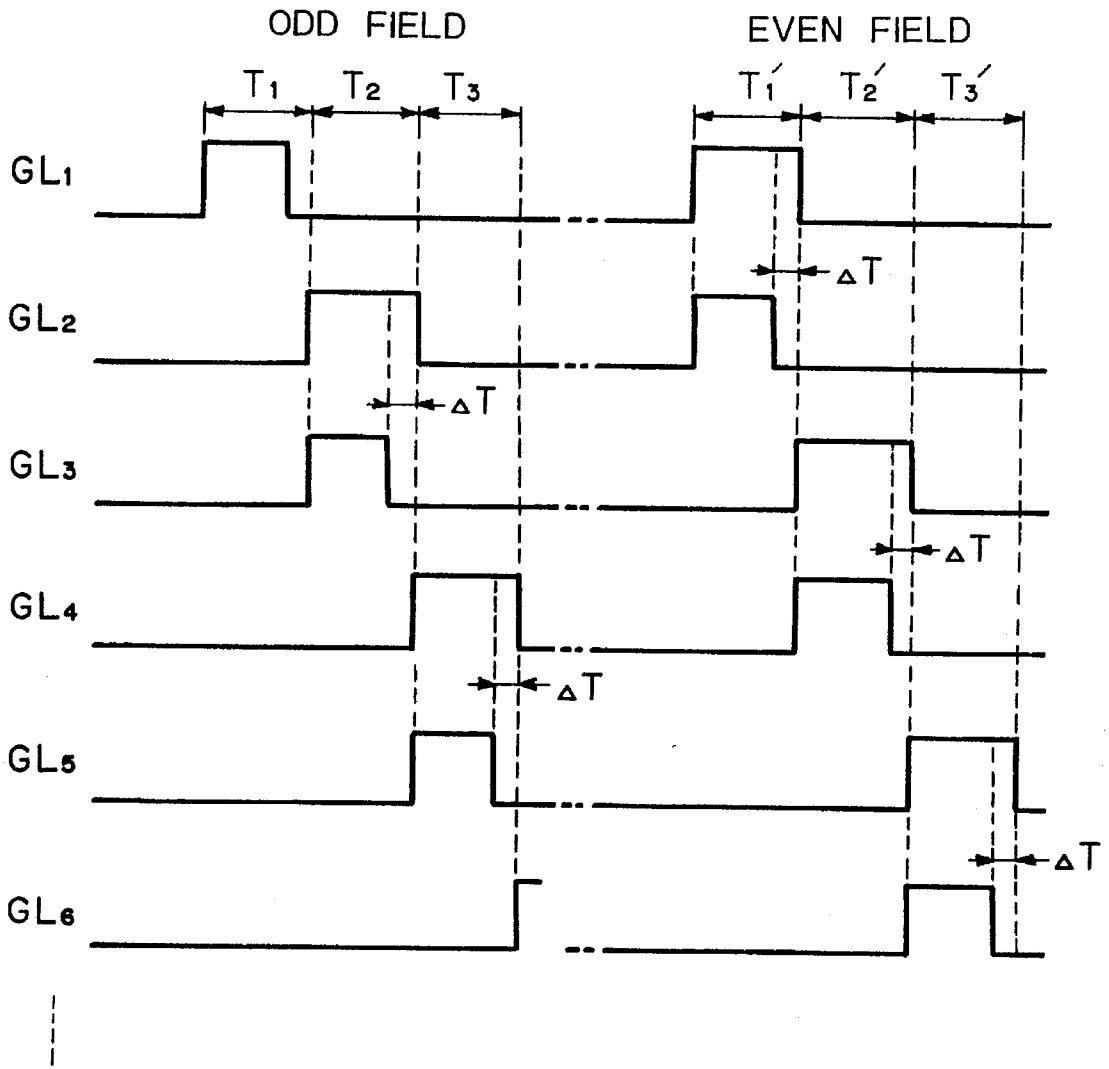
FIGS. 14A through 14F are timing diagrams explaining a second principle of the present invention.

In FIG. 12, which is a detailed circuit diagram of the gate line scanning circuit 2' of FIG. 11, the gate line scanning circuit 2' includes a shift register having 512 stages $S_1'', S_2'', \ldots$ and $S_{512}''$ for shifting the start pulse signal ST as shown in FIG. 13E in synchronization with the clock signal $\phi$and $\overline{\phi}$ as shown in FIGS. 13F and 13G to generate gate pulse signals for the gate lines $GL_1, GL_3, \ldots$, and $GL_{1023}$. In this case, the gate pulse signals are supplied via AND circuits $G_1, G_2, \ldots$, and $G_{512}$ controlled by the inhibit signal INHL as shown in FIG. 13C and buffers $B_1, B_2, \ldots$ and $B_{512}$ to the gate lines $GL_1, GL_3, \ldots$, and $GL_{1023}$. Therefore, the gate pulse signals applied to the gate lines $GL_1$, $GL_3$, and $GL_5$ are shown in FIGS. 13, 13J and 13L, respectively.

Also, switches SW1, SW2, . . . , and SW512 are provided. When the odd/even field signal O/E is "0" (odd field mode) as shown in FIGS. 13A and 13B, the switches SW1, SW3, . . . , and SW511 are turned OFF and the switches SW2, SW4, . . . , and SW512 are turned ON. As a result, the gate pulse signal applied to the gate line $GL_3$ is applied to the gate line $GL_2$, the gate pulse signal applied to the gate line $GL_5$ is applied to the gate line $GL_4$, and so on. Conversely, when the odd/even field signal O/E is "1" (even field mode), as shown in FIGS. 13A and 13B, the switches SW1, SW3, . . . , and SW511 are turned ON and the switches SW2, SW4, . . . , and SW512 are turned OFF. As result, the gate pulse signal applied to the gate line $GL_1$ is applied to the gate line $GL_2$, the gate pulse signal applied to the gate line $GL_3$ is applied to the gate line $GL_4$, and so on. In this case, the gate pulse signals are supplied via the AND circuits $G_1', G_2', \ldots$, and $G_{512}'$ controlled by the inhibit signal INHR as shown in FIG. 13D and the buffers $B_1', B_2', \ldots$, and $B_{512}'$ to the gate lines $GL_2, GL_4, \ldots$, and $GL_{1024}$. Therefore, the gate pulse signals applied to the gate lines $GL_2$, $GL_4$, and $GL_6$ are shown in FIGS. 13I, 13K and 13M, respectively.

In an odd field mode, the inhibit signal INHL is inactive and the inhibit signal INHR is active as shown in FIGS. 13C and 13D. Therefore, as shown in FIGS. 13H through 13M, the gate lines $GL_2$ and $GL_3$ are simultaneously driven, and the gate line $GL_2$ falls earlier than the gate line $GL_3$, and also, the gate lines $GL_4$ and $GL_5$ are simultaneously driven, and the gate line $GL_4$ falls earlier than the gate line $GL_5$.

In an even field mode, the inhibit signal INHL is active and the inhibit signal INHR is inactive as shown in FIGS. 13C and 13D. Therefore, as shown in FIGS. 13H through 13M, the gate lines $GL_1$ and $GL_2$ are simultaneously driven, and the gate line $GL_1$ falls earlier than the gate line $GL_2$. Also, the gate lines $GL_3$ and $GL_4$ are simultaneously driven, and the gate line $GL_3$ falls earlier than the gate line $GL_4$. Further, the gate lines $GL_5$ and $GL_6$ are simultaneously driven, and the gate line $GL_5$ falls earlier than the gate line $GL_6$.

Figure 15:
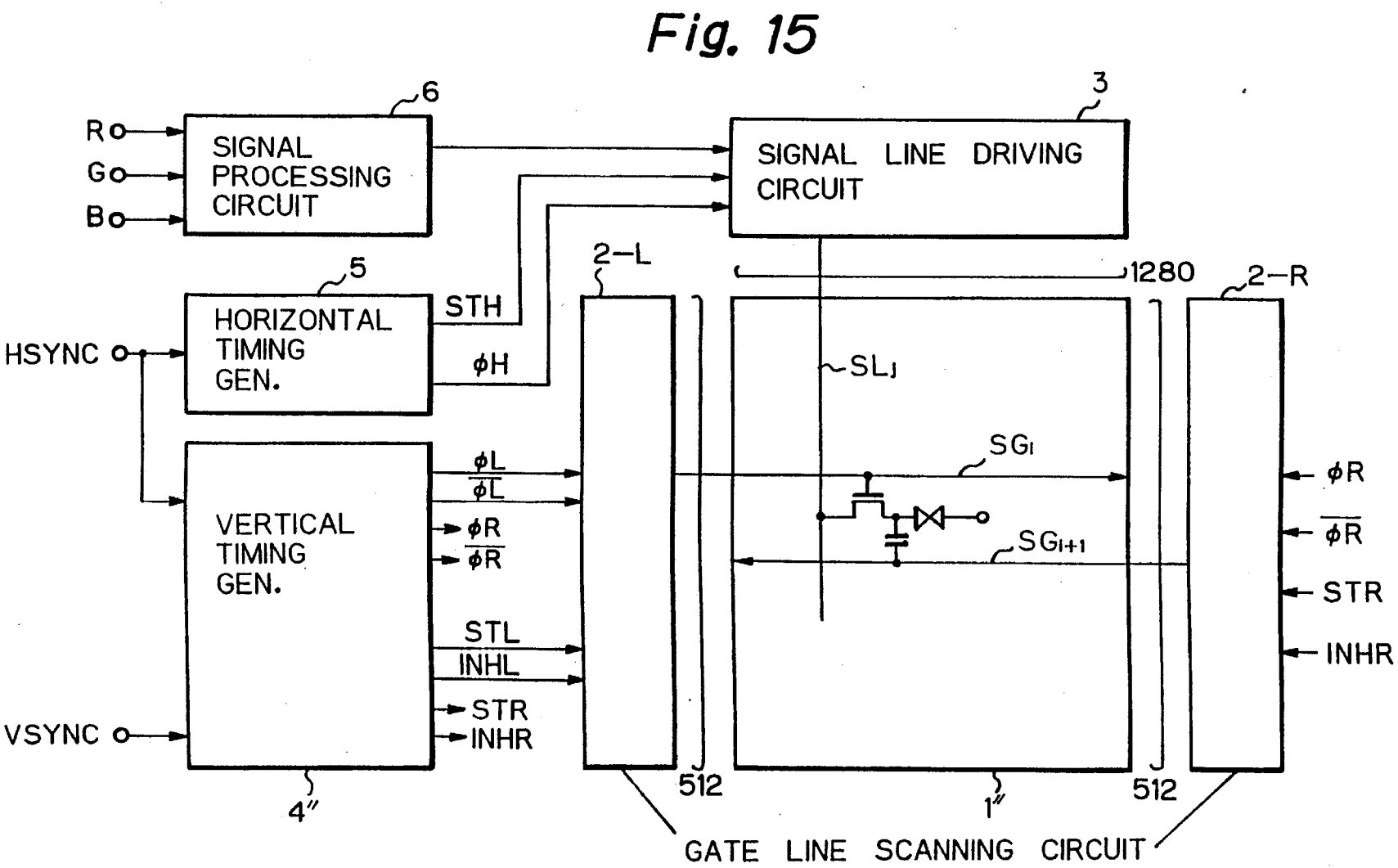
FIG. 15 is a circuit diagram illustrating a third embodiment of the gate storage type active matrix LCD panel according to the present invention.

In FIGS. 6 and 11, the storage capacitors belonging to the gate line $GL_i$ are connected to the gate line $GL_{i-1}$ located upstream along the scanning direction. However, the present invention can be applied to a case where the storage capacitors belonging to the gate line $GL_i$ are connected to the gate line $GL_{i+1}$ downstream along the scanning direction. In this case, a second principle of the present invention as shown in FIGS. 14A through 14F is adopted, and a third embodiment of the present invention for realizing this second principle is illustrated in FIG. 15. In FIG. 15, a pixel array 1" and a vertical timing generating circuit 4" are provided instead of the pixel array 1 and the vertical timing generating circuit 4 of FIG. 6. For example, in the pair of the gate lines $GL_4$ and $GL_5$ simultaneously driven for the time period $T_3$, the gate line $GL_5$ is changed from high to low by a time period $\Delta T$ prior to the change of the potential at the gate line $GL_4$. As a result, since a write operation upon the gate line $GL_5$ is also completed so that the potential at the gate line $GL_5$ is definite, the potential at the gate line $GL_5$ also hardly affects the potential at the liquid crystal cells belonging to the gate line $GL_4$.

Figure 16:
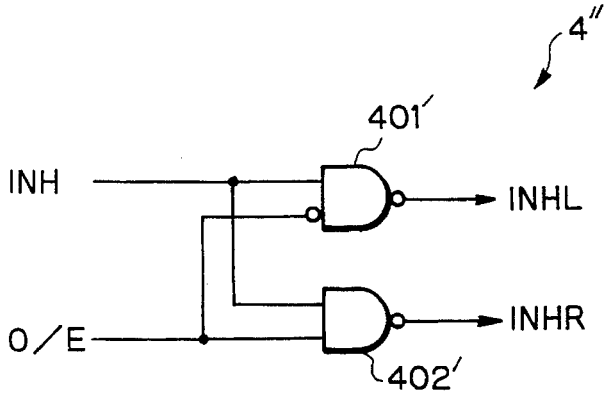
FIG. 16 is a partial circuit diagram of the vertical timing generating circuit of FIG. 15.

In FIG. 16, which is a partial circuit diagram of the vertical timing generating circuit 4" of FIG. 15, an inhibit signal INH as shown in FIG. 17A is supplied to NAND circuits 401' and 402' which are controlled by an odd/even field signal O/E as shown in FIG. 17B. That is, when the odd/even field signal O/E is "0" (odd field mode), the inhibit signal INHL for the gate line scanning circuit 2-L is active as shown in FIG. 17C and the inhibit signal INHR for the gate line scanning circuit 2-R is inactive as shown in FIG. 17D. Conversely, when the odd/even field signal O/E is "1" (even field mode), the inhibit signal INHL for the gate line scanning circuit 2-L is inactive as shown in FIG. 17C and the inhibit signal INHR for the gate line scanning circuit 2-R is active as shown in FIG. 17D.

Figures 18A, 18B, 18C, 18D, 18E, 18F, 18G, 18H, 18I, 18J, 18K, 18L, 18M, 18N:
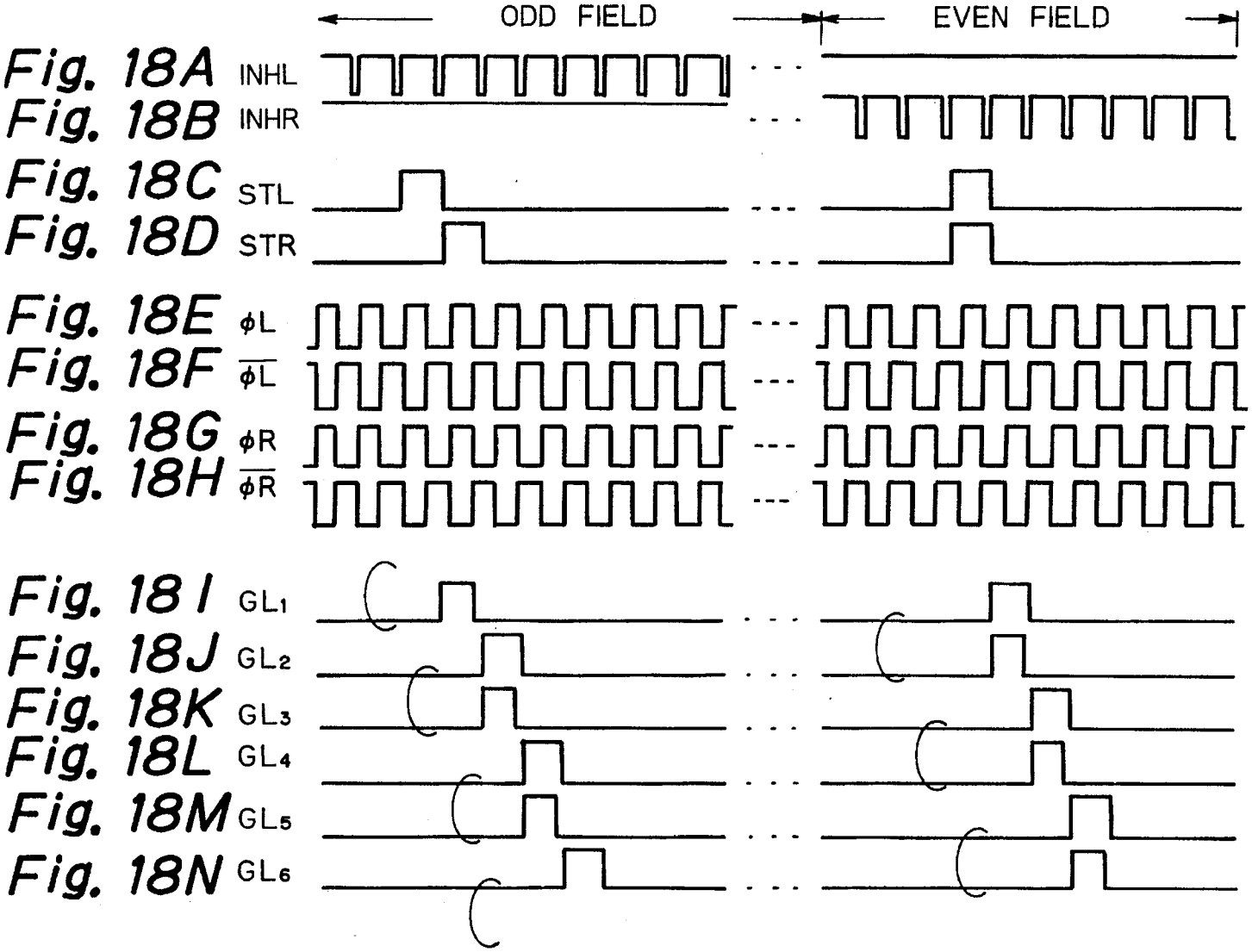
FIGS. 18A through 18N are timing diagrams showing the operation of the circuit of FIG. 9 applied to the LCD panel of FIG. 15.

The gate line scanning circuits 2-L and 2-R of FIG. 15 are operated as shown in FIGS. 18A through 18N. That is, in an odd field mode, the inhibit signal INHL is active and the inhibit signal INHR is inactive as shown in FIGS. 18A and 18B. Also, the phase of the start pulse signal STL associated with the clock signals $\phi L$ and $\overline{\phi L}$ is advanced as compared with that of the start pulse signal STR associated with the clock signals $\phi R$ and $\overline{\phi R}$, as shown in FIGS. 18C, 18E and 18F and FIGS. 18D, 18G and 18H. Therefore, as shown in FIGS. 18I through 18N, the gate lines $GL_2$ and $GL_3$ are simultaneously driven, and the gate line $GL_3$ falls earlier than the gate line $GL_2$, and also, the gate lines $GL_4$ and $GL_5$ are simultaneously driven, and the gate line $GL_5$ falls earlier than the gate line $GL_4$.

In an even field mode, the inhibit signal INHL is inactive and the inhibit signal INHR is active as shown in FIGS. 18A and 18B. Also, the phase of the start pulse signal STL associated with the clock signals $\phi L$ and $\overline{\phi L}$ is the same as that of the start pulse signal STR associated with the clock signals $\phi R$ and $\overline{\phi R}$, as shown in FIGS. 18C, 18E and 18F and FIGS. 18D, 18G and 18H. Therefore, as shown in FIGS. 18I through 18N, the gate lines $GL_1$ and $GL_2$ are simultaneously driven, and the gate line $GL_2$ falls earlier than the gate line $GL_1$. Also, the gate lines $GL_3$ and $GL_4$ are simultaneously driven, and the gate line $GL_4$ falls earlier than the gate line $GL_3$. Further, the gate lines $GL_5$ and $GL_6$ are simultaneously driven, and the gate line $GL_6$ falls earlier than the gate line $GL_5$.

Figure 19:
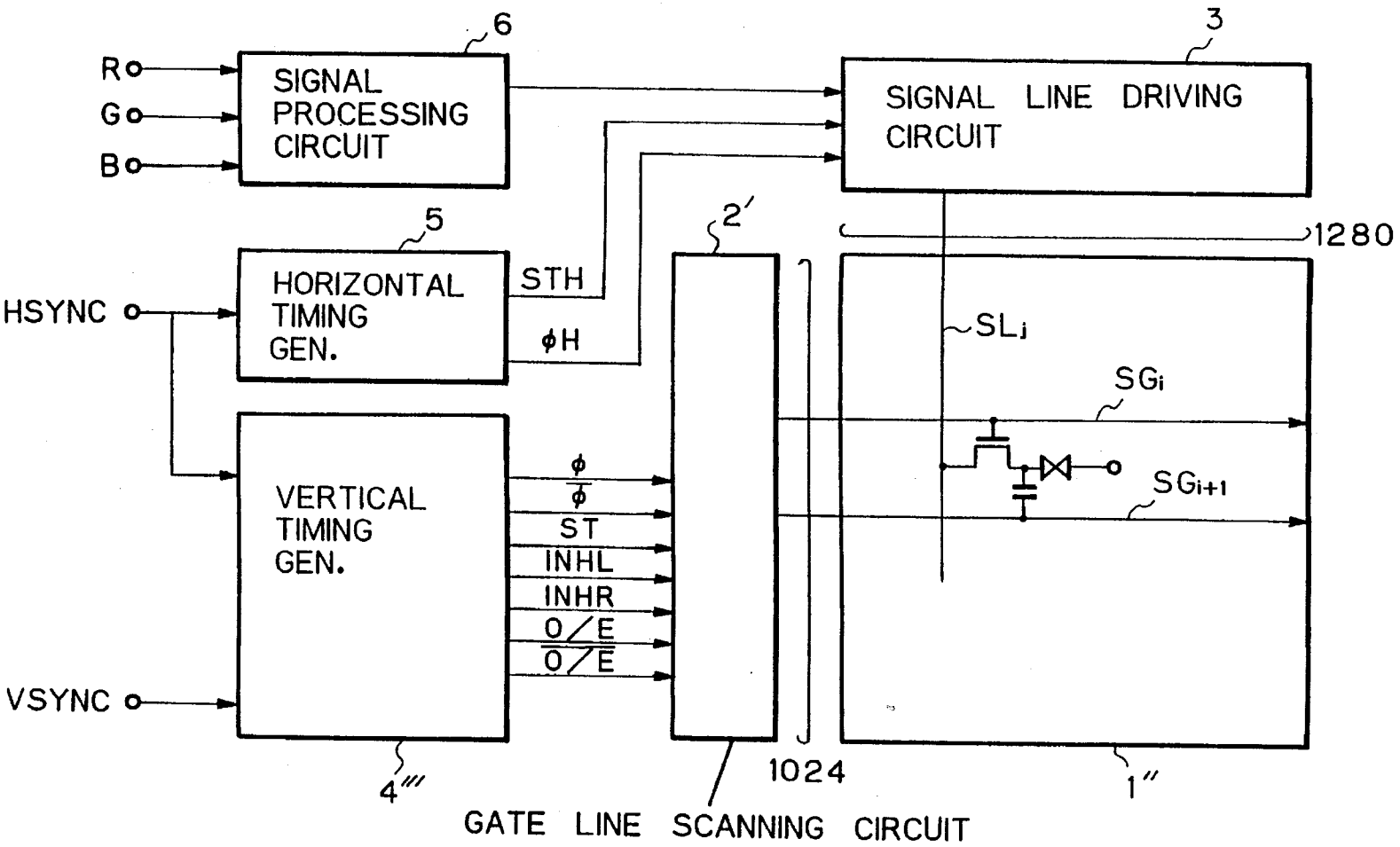
FIG. 19 is a circuit diagram illustrating a fourth embodiment of the gate storage type active matrix LCD panel according to the present invention.

In FIG. 19, which is a fourth embodiment of the present invention for realizing the second principle of FIGS. 14A through 14F, a gate line scanning circuit 2' is provided instead of the gate line scanning circuit 2-L and 2-R of FIG. 15, and a vertical timing generating circuit 4''' is provided instead of the vertical timing generating circuit 4'' of FIG. 15.

The vertical timing generating circuit 4''' is the same as the vertical timing generating circuit 4' of FIG. 11 except for the inhibit signals INHL and INHR.

The gate line scanning circuit 2' of FIG. 19 is operated as shown in FIGS. 20A through 20M.

Figures 20A, 20B, 20C, 20D, 20E, 20F, 20G, 20H, 20I, 20J, 20K, 20L, 20M:
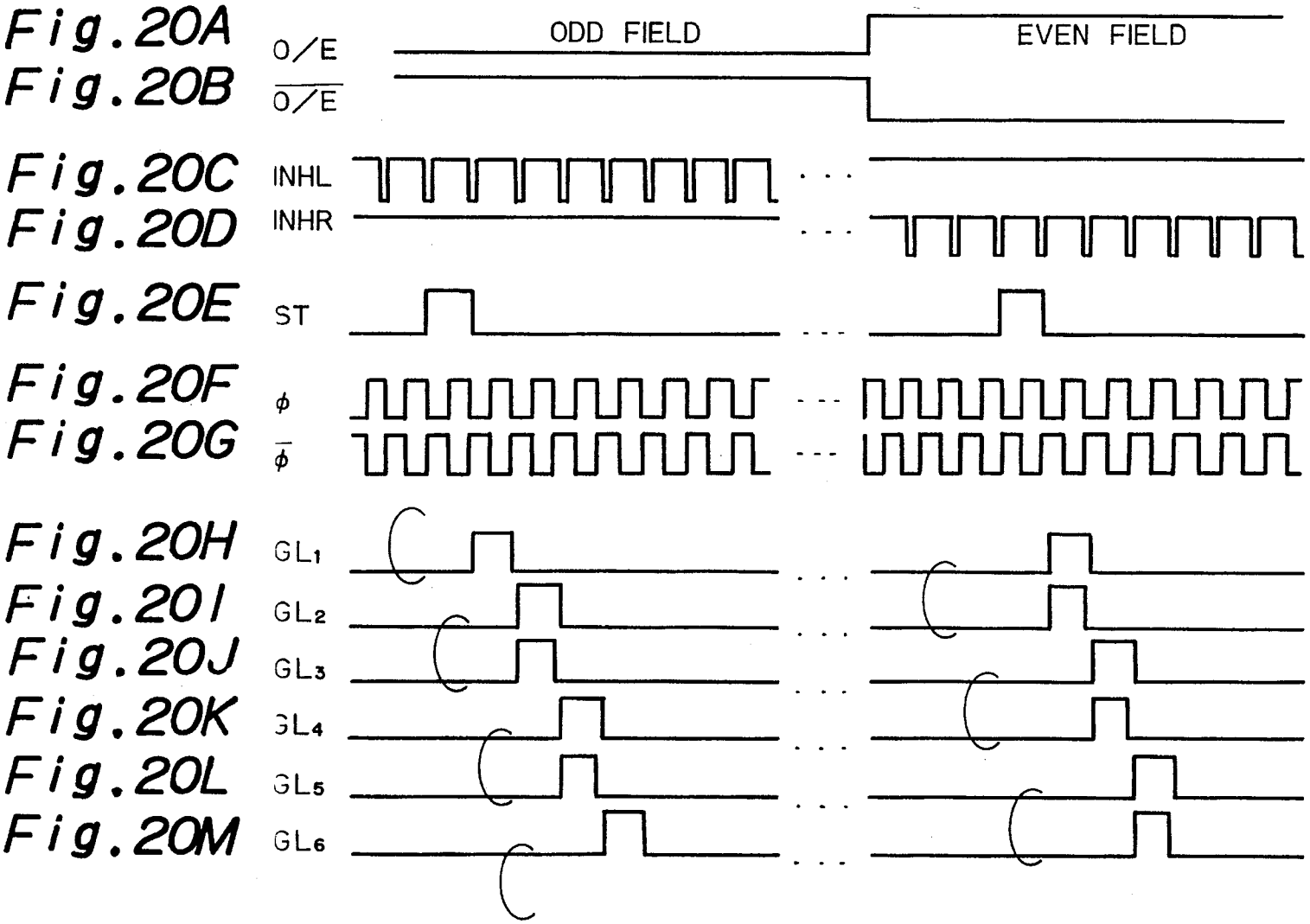
FIGS. 20A through 20M are timing diagrams showing the operation of the circuit of FIG. 12 applied to the LCD panel of FIG. 19.
Figures 21A, 21B, 21C, 21D, 21E, 21F:
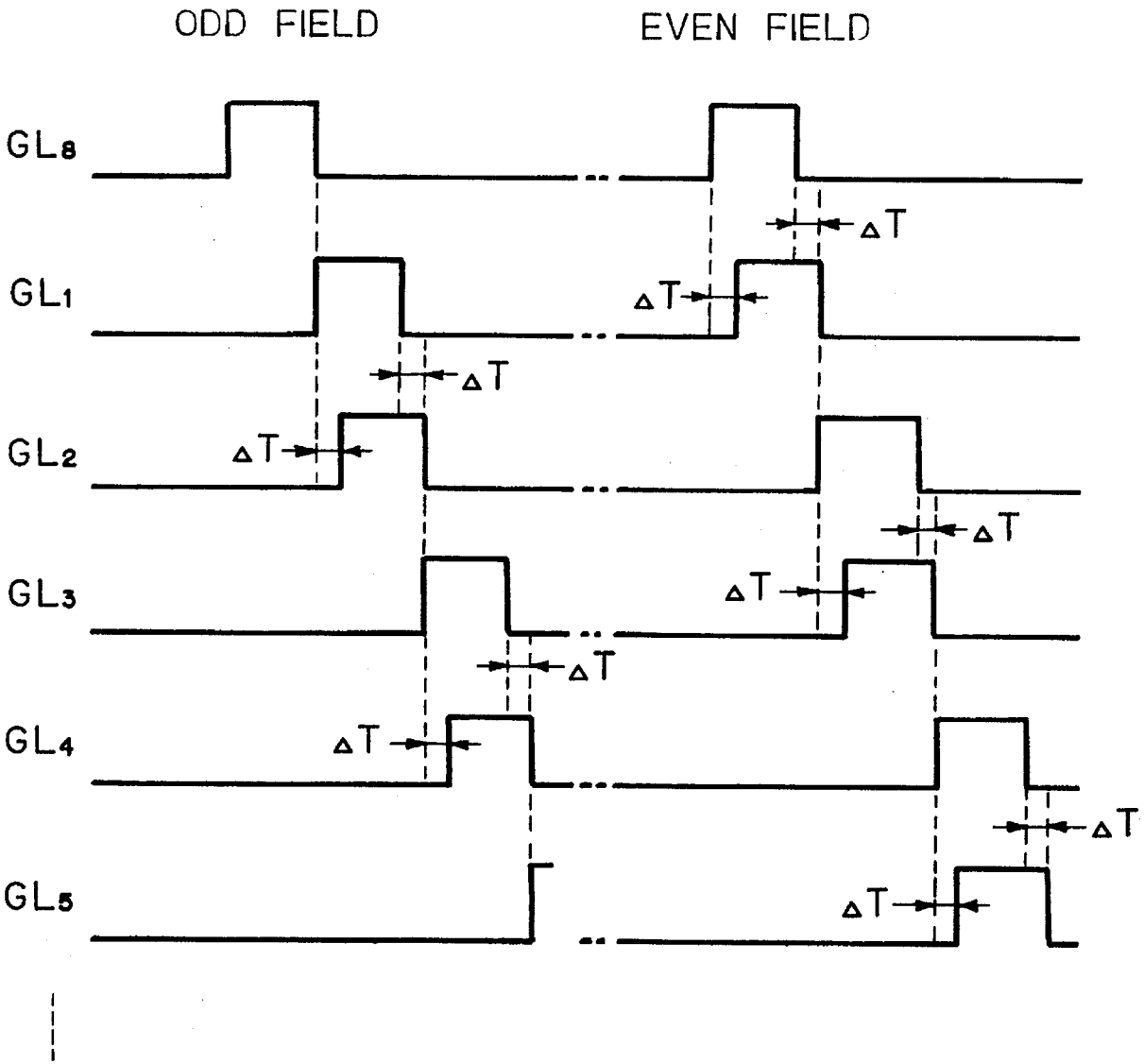
FIGS. 21A through 21F are timing diagrams illustrating a modification of the first principle of the present invention as illustrated in FIGS. 5A through 5F.
Figures 22A, 22B, 22C, 22D, 22E, 22F:
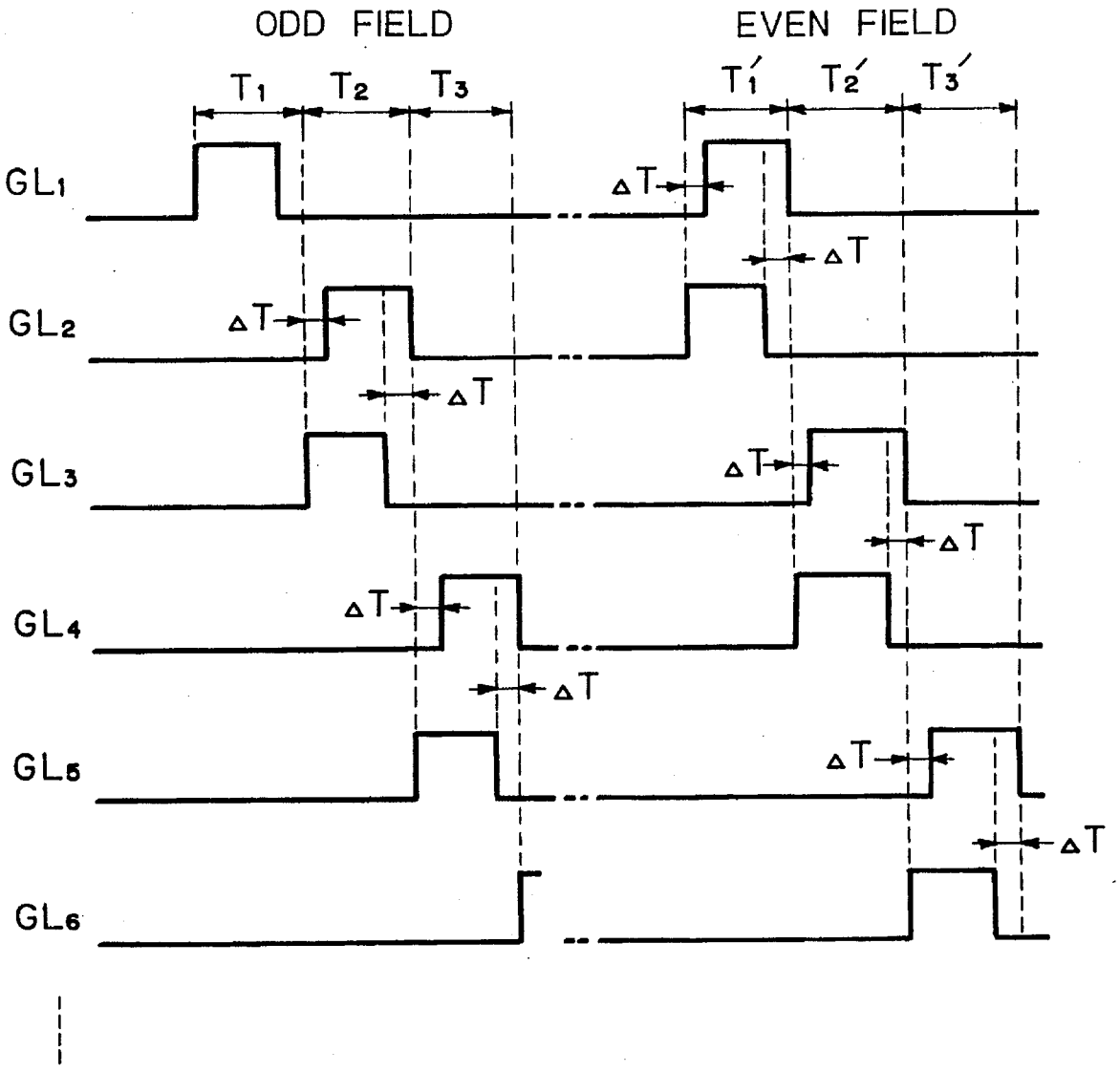
FIGS. 22A through 22F are timing diagrams illustrating a modification of the second principle of the present invention as illustrated in FIGS. 14A through 14F.

In an odd field mode, the inhibit signal INHL is active and the inhibit signal INHR is inactive as shown in FIGS. 20C and 20D. Therefore, as shown in FIGS. 20H through 20M, the gate lines $GL_2$ and $GL_3$ are simultaneously driven, and the gate line $GL_3$ falls earlier than the gate line $GL_2$, and also, the gate lines $GL_4$ and $GL_5$ are simultaneously driven, and the gate line $GL_5$ falls earlier than the gate line $GL_4$.

In an even field mode, the inhibit signal INHL is inactive and the inhibit signal INHR is active as shown in FIGS. 20C and 20D. Therefore, as shown in FIGS. 20H through 20M, the gate lines $GL_1$ and $GL_2$ are simultaneously driven, and the gate line $GL_2$ falls earlier than the gate line $GL_1$. Also, the gate lines $GL_3$ and $GL_4$ are simultaneously driven, and the gate line $GL_4$ falls earlier than the gate line $GL_3$. Further, the gate lines $GL_5$ and $GL_6$ are simultaneously driven, and the gate line $GL_6$ falls earlier than the gate line $GL_5$.

In FIGS. 21A through 21F, which are timing diagrams showing a modification of the first principle of the present invention as shown in FIGS. 5A through 5F, the pulse widths of the gate pulse signals are the same. Also, in FIGS. 22A through 22F, which are timing diagrams showing a modification of the second principle of the present invention as shown in FIGS. 14A through 14F, the pulse widths of the gate pulse signals are the same. These modifications may simplify the circuits as illustrated in FIGS. 6, 11, 15 and 19.

As explained hereinbefore, according to the present invention, in a gate storage type LCD panel, the two gate line driving method can be carried out.

I claim:

1. An apparatus for driving a liquid crystal display panel having a plurality of gate lines, a plurality of signal lines and a plurality of pixels, each pixel including a liquid crystal cell, a switching transistor connected between said liquid crystal cell and one of said signal lines and having a gate connected to one of said gate lines, and a storage capacitor connected between said liquid crystal cell and another gate line adjacent to the same one of said gate lines, the apparatus comprising:

means for simultaneously generating two gate pulse signals and transmitting the two gate pulse signals to two adjacent ones of said gate lines; and means for controlling pulse widths of the two gate pulse signals so that at least one of a rising edge and a falling edge of one of the two gate pulses is different from that of the other, wherein the storage capacitor belonging to one of said gate lines is connected to another of said gate lines located upstream in a scanning direction, and said pulse width controlling means turning OFF the other gate line prior to turning OFF the one gate line.

2. An apparatus for driving a liquid crystal display panel having 2M gate lines, 2N signal lines and 2M×2N pixels, each pixel including a liquid crystal cell, a switching transistor connected between said liquid crystal cell and one of said signal lines and having a gate connected to one of said gate lines, and a storage capacitor connected between said liquid crystal cell and another gate line adjacent to the one of said gate lines, the apparatus comprising:

a first start pulse generating means for generating a first start pulse signal;

a second start pulse generating means for generating a second start pulse signal;

first serially-connected shift registers, connected to said first pulse generating means, for shifting the first start pulse signal to generate first gate pulse signals for a first group defined by the 1st, 3rd, . . . , and (2M−1)-th gate lines of said gate lines;

second serially-connected shift registers, connected to said second pulse generating means, for shifting the second start pulse signal to generate second gate pulse signals for a second group defined by the 2nd, 4th, . . . , and 2M-th gate lines of said gate lines;

first inhibiting means, connected between said first serially-connected shift registers and the first group of said gate lines, for inhibiting the transition of the first gate pulse signals from said first serially-connected shift registers to the first group of said gate lines for a first time period; and second inhibiting means, connected between said second serially-connected shift registers and the second group of said gate lines, for inhibiting the transition of the second gate pulse signals from said second serially-connected shift registers to the second group of said gate lines for a second time period.

3. An apparatus as set forth in claim 2, wherein the first and second start pulse signals are out of phase in an odd field mode, the first and second start pulse signals being in phase in an even field mode.

4. An apparatus as set forth in claim 2, wherein the storage capacitor belonging to one of said gate lines is connected to another of said gate lines located upstream along a scanning direction, said first and second inhibiting means being disabled and enabled, respectively, in an odd field mode, said first and second inhibiting means being enabled and disabled, respectively, in an even field mode.

5. An apparatus as set forth in claim 2, wherein the storage capacitor belonging to one of said gate lines is connected to another of said gate lines located downstream along a scanning direction, said first and second inhibiting means being enabled and disabled, respectively, in an odd field mode, said first and second inhibiting means being disabled and enabled, respectively, in an even field mode.

6. An apparatus as set forth in claim 2, wherein the first time period corresponds to a definite time period including a termination edge of each of the first gate pulse signals, the second time period corresponding to a definite time period including a termination edge of each of the second gate pulse signals.

7. An apparatus for driving a liquid crystal display panel having 2M gate lines, 2N signal lines and 2M×2N pixels, each pixel including a liquid crystal cell, a switching transistor connected between said liquid crystal cell and one of said signal lines and having a gate connected to one of said gate lines, and a storage capacitor connected between said liquid crystal cell and another gate line adjacent to the one of said gate lines, the apparatus comprising:

a start pulse generating means for generating a start pulse signal;

serially-connected shift registers, connected to said pulse generating means, for shifting the start pulse signal to generate 1st, 3rd, . . . , and (2M−1)-th gate pulse signals for the 1st, 3rd, . . . , and (2M−1)-th gate lines of said gate lines;

switching means, connected to said serially-connected shift registers, for supplying the 3rd, 5th, . . . , and (2M−1)-th gate pulse signals as 2nd, 4th, . . . , and (2M−1)-th gate pulse signals to the 2nd, 4th, . . . , and (2M−2)-th gate lines in an odd field mode, and supplying the 1st, 3rd, . . . , and (2M−1)-th gate pulse signals to the 2nd, 4th, . . . , and 2M-th gate pulse signals as 2nd, 4th, . . . , and 2M-th gate lines in an even field mode;

first inhibiting means, connected between said serially-connected shift registers and the 1st, 3rd, . . . , and (2M−1)-th gate lines, for inhibiting the transition of the 1st, 3rd, . . . , and (2M−1)-th gate pulse signals from said serially-connected shift registers to the 1st, 3rd, . . . , and (2M−1)-th gate lines for a first time period in said even field mode; and second inhibiting means, connected between said switching means and the 2nd, 4th, . . . , and 2M-th gate lines, for inhibiting the transition of the 1st, 3rd, . . . , and (2M−1)-th gate pulse signals from said switching means to the 2nd, 4th, . . . , and 2M-th gate lines for a second time period in said odd field mode.

8. An apparatus as set forth in claim 7, wherein the storage capacitor belonging to one of said gate lines is connected to another of said gate lines located upstream along a scanning direction, said first and second inhibiting means being disabled and enabled, respectively, in an odd field mode, said first and second inhibiting means being enabled and disabled, respectively, in an even field mode.

9. An apparatus as set forth in claim 7, wherein the storage capacitor belonging to one of said gate lines is connected to another of said gate lines located downstream along a scanning direction, said first and second inhibiting means being enabled and disabled, respectively, in an odd field mode, said first and second inhibiting means being disabled and enabled, respectively, in an even field mode.

10. An apparatus as set forth in claim 7, wherein the first time period corresponds to a definite time period including a termination edge of each of the first gate pulse signals, the second time period corresponding to a definite time period including a termination edge of each of the second gate pulse signals.

* * * * *

UNITED STATES PATENT AND TRADEMARK OFFICE

CERTIFICATE OF CORRECTION

PATENT NO. : 5,568,163

DATED : October 22, 1996

INVENTOR(S) : Fujio Okumura

It is certified that error appears in the above-indentified patent and that said Letters Patent is hereby corrected as shown below:

On the title page, at Item [54], the title "APPARATUS FOR DRIVING GATE STORAGE TYPE LIQUID CRYSTAL, DISPLAY PANEL CAPABLE OF SIMULTANEOUSLY DRIVING TWO SCAN LINES" should read --APPARATUS FOR DRIVING GATE STORAGE TYPE LIQUID CRYSTAL DISPLAY PANEL CAPABLE OF SIMULTANEOUSLY DRIVING TWO SCAN LINES--.

Signed and Sealed this

Twenty-ninth Day of April, 1997

Bruce Lehman

*Attest:*

BRUCE LEHMAN

*Attesting Officer*

*Commissioner of Patents and Trademarks*